United States Patent [19]

Koreeda et al.

[11] Patent Number: 4,670,002

[45] Date of Patent: Jun. 2, 1987

[54] CENTRIFUGAL ELUTRIATOR ROTOR

[75] Inventors: Masakuni Koreeda; Akio Nagata; Sadamoto Tachihara, all of Katsuta, Japan

[73] Assignee: Hitachi Koki Company, Ltd., Tokyo, Japan

[21] Appl. No.: 806,317

[22] Filed: Dec. 9, 1985

[51] Int. Cl.[4] ..... B04B 11/00

[52] U.S. Cl. ..... 494/10; 494/38

[58] Field of Search ..... 494/10, 23, 27, 37, 494/29, 30, 35, 38, 41, 43

[56] References Cited

U.S. PATENT DOCUMENTS 3,825,175 7/1974 Sartory ..... 494/27

4,350,283 9/1982 Leonian ..... 494/10

FOREIGN PATENT DOCUMENTS 2426908 1/1975 Fed. Rep. of Germany .

*Primary Examiner*—Timothy F. Simone

*Attorney, Agent, or Firm*—Pollock, VandeSande & Priddy

[57] ABSTRACT

A rotor for separation and collection of specimen particles carried by a liquid buffer by continuous centrifugal elutriation, whereby the interior of the rotor itself is employed as a separation chamber. This separation chamber is shaped such that the circumferential cross-sectional area thereof continuously increases from the outer to the inner periphery in a specific manner, so that centrifugal elutriation is accomplished by pumping the liquid buffer from positions at the outer periphery of the separation chamber towards the inner periphery. A transparent cover can be employed to cover the separation chamber, so that the separated material becomes directly visible as a peripheral ring, without the need to employ a stroboflash lamp, and in addition it is possible to separate large amounts of material by a single centrifuging operation.

6 Claims, 2 Drawing Figures

CENTRIFUGAL ELUTRIATOR ROTOR

BACKGROUND OF THE INVENTION

The present invention relates to a centrifugal elutriator rotor, i.e. a centrifuge rotor for continuous separation of different types of specimen particles carried by a liquid buffer that is pumped through the rotor. The basic principles of a centrifugal elutriator rotor can be summarized as follows. The liquid buffer (such as water) carrying the specimen particles, is pumped from an outer end of a separation chamber, disposed within a rotating rotor, and pass through this chamber along a path directed substantially radially inward with respect to the axis of rotation of the rotor, and hence to the inner end of the separation chamber. Separation of particles having respectively different physical properties, e.g. different size, is thereby accomplished based on the relationship between the respective values of centrifugal force and liquid flow force acting upon the specimen particles. These forces will be determined at any instant during the elutriation process, for each particle, by the distance of the particle from the axis of rotation of the rotor, the particle size, and the rate of flow of the liquid buffer carrying the particle at that instant. An example of such a centrifugal elutriator rotor is described in U.S. Pat. No. 4,350,283. However such a prior art type of centrifugal elutriator rotor presents the following problems. Firstly, separation is carried out within a short tubular elutriation cell which is attached in the body of the rotor. Thus, the volume of the rotor which is actually utilized for separation purposes is very small, so that the efficiency of separation is low, i.e. the amount of material which can be separated by a single centrifuging operation, is small. In addition, the elutriation cell must be removed from the interior of the rotor, then once more attached therein, e.g. by screwing and unscrewing an end cap which retains the cell within the rotor, each time a centrifuging operation is repeated. Thus, operation is inconvenient and time-consuming.

A further disadvantage of this prior art rotor, which also applies to various other types of prior art centrifugal elutriator rotor, is that it is necessary for the operator to employ a stroboflash type of light source in order to observe the progress of separation of specimen particles while the rotor is rotating. This is necessitated by the fact that the elutriation process is performed only within a segment of the rotor.

SUMMARY OF THE INVENTION

It is an objective of the present invention to overcome the disadvantages of prior art types of centrifugal elutriator rotor as described above, and to enable a large quantity of specimen particles to be separated by a single centrifugal separation operation. It is a further advantage of the present invention to provide a centrifugal elutriator rotor which does not require preparatory work to be carried out prior to each centrifugal separation operation. It is yet another object of the present invention to provide a centrifugal elutriator rotor which permits the degree of separation of specimen particles to be directly viewed while separation is in progress, without the necessity for employing means such as a stroboflash lamp for such viewing.

In order to achieve the above objectives, a centrifugal elutriator rotor according to the present invention is adapted to be driven about a fixed axis of rotation by drive means, and essentially comprises an outer body which internally defines a separation chamber shaped such that the areas of circumferential cross-sections thereof, which are coaxial with the axis of rotation of the rotor and are directed substantially perpendicular to the direction of flow of liquid buffer within the separation chamber, continuously increase from the outer periphery to the inner periphery of the separation chamber, and moreover comprises fluid delivery inlet means for delivering fluid to the outer periphery of the separation chamber and fluid delivery outlet means for outlet of fluid from the inner periphery of the separation chamber.

The outer body is preferably formed of a rotor body which is open at the top thereof and which is internally shaped such as to provide the separation chamber shape referred to above, and a cover formed of a transparent material which is removably attached to the top of the rotor body. A plurality of partitions, oriented radially about the axis of rotation of the rotor, are preferably fixedly disposed within the separation chamber to divide this into a number of small separation chambers, with part of the fluid delivery inlet means comprising radially directed passages formed in these partitions for delivering fluid from positions adjacent to the axis of rotation to the outer peripheries of these small separation chambers.

SUMMARY OF THE PREFERRED EMBODIMENTS

Figure 1:
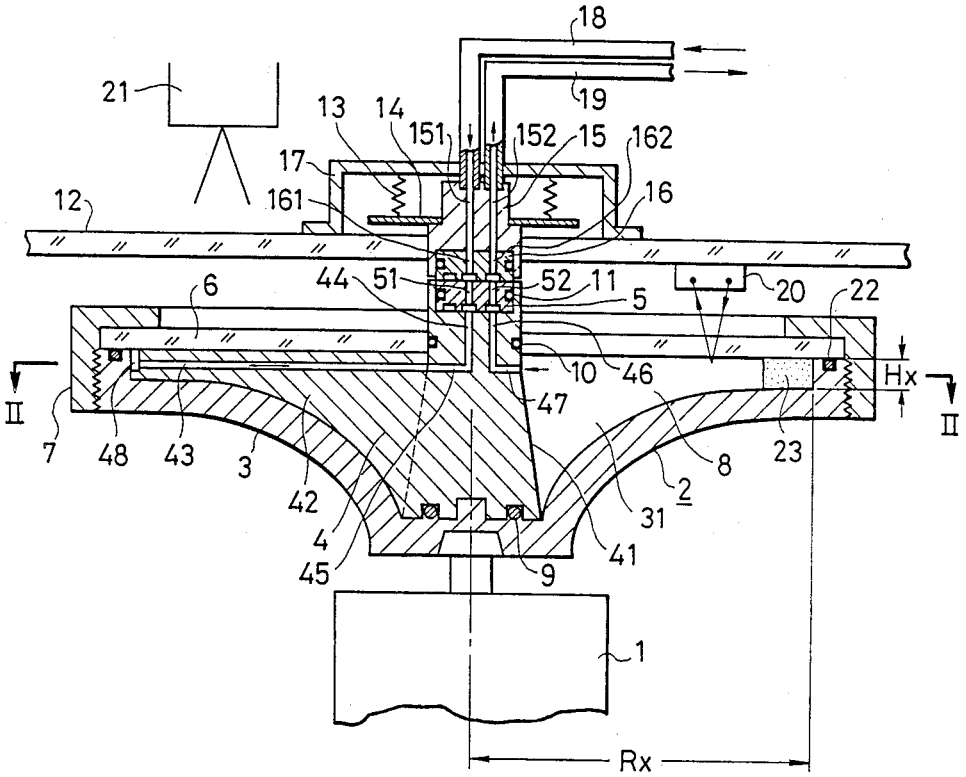
FIG. 1 is a cross-sectional view in elevation of an embodiment of a centrifugal elutriator rotor according to the present invention, taken through lines I—I in FIG. 2.

In the drawings, reference numeral 1 denotes an electric motor, numeral 2 denotes a rotor whch is rotated by the motor 1. The rotor 2 includes a rotor body 3 and a core 4, together with a transparent cover 5. A concave region 31, of upwardly opening shape, is formed in rotor body 3. The core 4 is disposed within the concave region 31, concentric with the center of rotation of rotor body 3, and is formed of a central shaft 41 and four partitions 42 which extend radially outward from shaft 41 at equidistant angular spacings. Each of the partitions 42 has a passage 43 formed therein, extending radially from the periphery of core 41 to the outer end of that partition. A vertically extending passage 44 is formed in core 41, aligned with the axis of rotation of rotor 2, together with a set of four lateral passages denoted by numeral 45. Each of the lateral passages 45 communicates with axial passage 44 , extending from the lower end thereof, and extends radially outward from the axis of rotation of rotor 2 to communicate with the inner end of a corresponding one of the passages 43 formed in partitions 42, i.e. lateral passages 45 are disposed at equidistant angular spacings corresponding to those of partitions 42. A set of four vertically oriented passages 46 are also formed in shaft 41, disposed parallel to the axis of rotation of rotor 2 and spaced concentrically around that axis at equidistant angular intervals. The lower ends of the vertical shafts 46 respectively communicate with lateral passages 47 which are formed in shaft 41, extending radially outward to open into a separation chamber as described hereinafter. In addition a rotary seal 5 is disposed at the upper end of shaft 41. The rotary seal 5 has a passage 51 formed vertically at the center thereof, which communicates with the central vertical passage 44, and a vertical passage 52 which communicates with each of passages 46.

Reference numeral 6 denotes a cover formed of a transparent material, which is removably attached to rotor body 3 and core 4 by means of an attachment ring 7. The attachment ring 7 has a screw thread formed thereon which engages in a corresponding screw thread formed around the outer periphery of rotor body 3.

Figure 2:
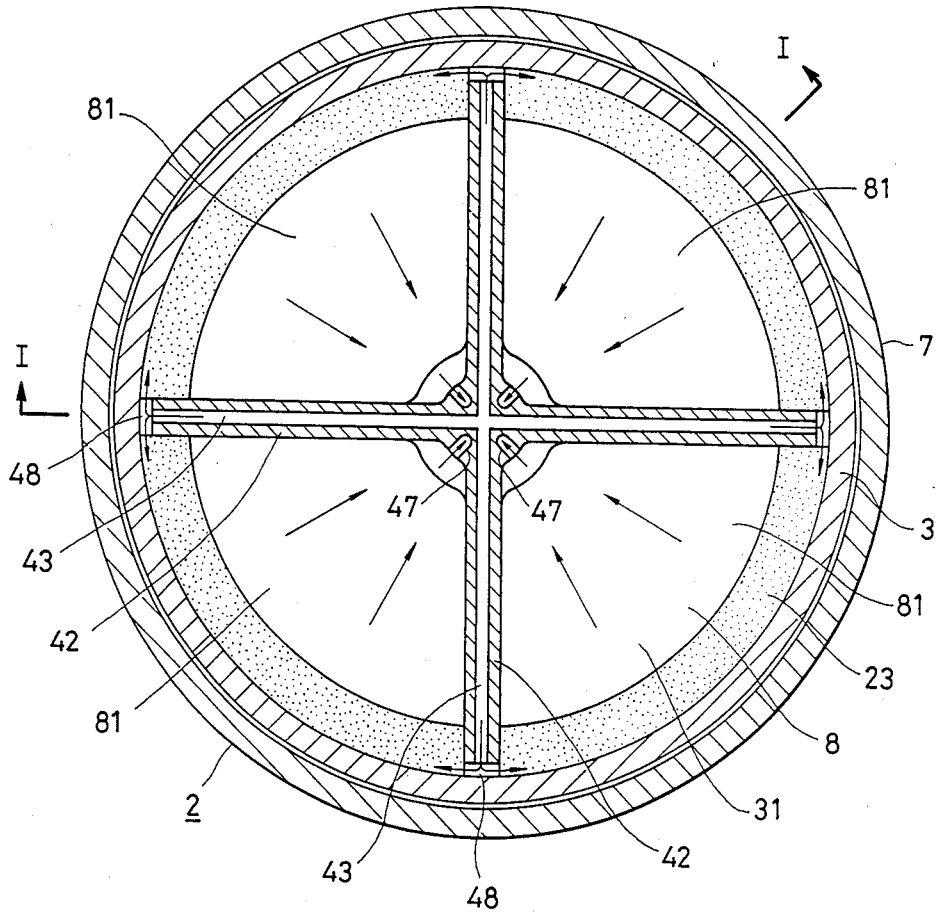
FIG. 2 is a cross-sectional view in plan of the embodiment of FIG. 1, taken through lines II—II in FIG. 1.

Reference numeral 8 denotes a separation chamber, which is formed between the concave portion 31 of rotor body 3 and the cover 6. As can be understood from the cross-sectional plan view of FIG. 2, the partitions 42 divide the separation chamber 8 into a set of four small separation chambers 81. The lateral passages 43 communicate through notches 48 formed in the outer ends of partitions 42 with the small chambers 81, i.e. the outer ends of the passages 43 open into the notches 48. Numerals 9, 10, 12 and 22 denote sealing rings.

Reference numeral 12 denotes an upper plate, formed of a transparent material, which constitutes part of the outer body of the centrifugal separator mechanism which includes rotor 2. A sealing member 15 is supported in a manner permitting a limited range of movement in the vertical direction by means of coil springs 13 in conjunction with a supporting bracket 14 which is mounted upon upper plate 12. A fixed seal 16 is attached to the lower end of sealing member 15, in contact with the rotary seal 5. The fixed seal 16 has passages 161 162 formed therein, with the lower end of passage 161 communicating with the upper end of passage 51 and with the lower ends of passage 162 communicating with the upper end of passage 52. The upper end of passage 161 communicates with the lower end of passage 151, while the upper end of passage 162 communicates with the lower end of passage 152.

Reference numeral 17 denotes a spring restraint member which is fixedly attached to upper plate 12 by means such as bolts. An injection pipe 18 is connected at the upper end of passage 151, while an outlet pipe 19 is connected to the upper end of passage 152. It can thus be understood that the passages 151, 161, 51, 44, 45 and 43 constitute a set of successively communicating fluid delivery passages, while the passages 152, 162, 52, 46 and 47 constitute a set of successively communicating fluid discharge passages.

Reference numeral 20 denotes a photo-sensor unit which is mounted on the lower face of upper plate 12, and includes a photo-emissive section and a photoreceptive section. Photo-sensor unit 20 is utilized to monitor a separation layer, formed as described hereinafter.

Numeral 21 denotes a light source which is disposed above the upper plate 12, and serves to illuminate the top of rotor 2 for direct observation of the general separation status.

The operation of this embodiment is as follows. A fluid buffer carrying specimen particles, from which specific types of particles are to be separated, is pumped through the injection pipe 18 while rotor 2 is being rotated by motor 1. This fluid passes through the set of fluid delivery passages described above into the small separation chambers 81, at the extreme periphery thereof, and thereafter centrifugal elutriation takes place. That is to say, as the fluid flows from the periphery of the small separation chambers 81, as indicated by the arrows in FIG. 2, the velocity of flow of the fluid will continuously decrease in a predetermined manner, i.e. as determined by the shape of separation chamber 8. For each specimen particle, when the flow velocity has decreased to a value at which the centrifugal force acting upon that particle becomes equal to the force exerted thereon by the fluid flow, the particle will be restrained against further movement towards the axis of rotation of rotor 2. The distance from the axis of rotation of rotor 2 at which this condition of balance occurs will depend upon certain physical properties of the particle, e.g. larger particles will be transported radially inward to a greater distance than will smaller particles, so that separation of particles into specific types will occur. The above principle is common to prior art types of centrifugal elutriator rotor. However it is a unique feature of the present invention that this separation process takes place within the entirity of separation chamber 8, which occupies most of the volume of the interior of rotor 2, rather than within a cell whose volume is only a very small part of the overall size of the rotor, as is the case with prior art types of centrifugal elutriation rotors.

In order to perform separation as described above, the areas of circumferential cross-sections of the interior of separation chamber 8, each cross-section being taken around the axis of rotation of rotor 2 and concentric therewith and being disposed substantially perpendicular to the direction of flow of the liquid buffer, must successively increase from the outer periphery of separation chamber 8 to the outer periphery thereof, with the areas being inversely proportional to the radial distance of each circumferential cross-section from the axis of rotation of rotor 2. The area Sx of a corresponding circumferential segment cross-section of any of the small separation chambers 81 is given as follows:

$$Sx = \frac{2\pi \cdot Rx \cdot Hx}{4}$$

where Rx is the radial distance of that cross-section from the axis of rotation of rotor 2, and Hx is the corresponding height of the separation chamber 8.

With the described embodiment, the above requirement for the shape of separation chamber 8 is satisfied by forming the lower face of the interior of separation chamber 8 with a specific concave curvature, as indicated by numeral 31, while the transparent cover 6 has a flat lower surface.

Due to this shape adopted for separation chamber 8, separation of the specimen particles will be performed in accordance with particle size, in accordance with the angular velocity of rotor 2 and the rate of flow of the liquid buffer. Particles which are of small size will be relatively strongly affected by the flow force exerted thereon by the liquid buffer in which they are carried, by comparison with the effects of this flow force upon larger particles, while large particles will be more strongly affected by centrifugal force than will be the smaller particles. As a result, the large specimen particles will be retained within a region near the periphery of separation chamber 8, as indicated by reference numeral 23 in FIG. 1, while small particles will be carried by the liquid buffer to the inner periphery of separation chamber 8 and hence will flow outward from separation chamber 8 along the flow path described hereinabove.

From the above description of the preferred embodiment, it can be understood that a centrifugal elutriator rotor according to the present invention essentially comprises an outer body (e.g. the combination of cover 6 and rotor body 3) which internally defines a separation chamber, shaped such that the areas of circumferential cross-sections thereof which are coaxial with the axis of rotation of the rotor and are directed substantially perpendicular to the direction of flow of liquid buffer within the separation chamber, continuously increase from the outer periphery to the inner periphery of the separation chamber, and moreover comprises fluid delivery inlet means (which in the embodiment includes pipe 18, and passages 151, 161, 51, 44, and 43) for delivering fluid to the outer periphery of the separation chamber and fluid delivery outlet means (which in the embodiment includes passages 47, 46, 52, 162, and pipe 19) for outlet of fluid from the inner periphery of the separation chamber.

With a centrifugal elutriator rotor according to the present invention, a large amount of specimen particles can be separated by a single centrifuging operation, so that separation is performed highly efficiently. As is made clear by the described embodiment, the rotor itself functions as a container for the separated specimen, and the cover can be rapidly opened for removal of the specimen after centrifuging. Thus, the necessity of repeatedly removing and replacing a small separation cell within the rotor, such as is required by prior art types of centrifugal elutriator rotor, is eliminated. In addition, due to the fact that the separated particles remain close to the periphery of separation chamber 8, the particles will be clearly visible as a ring-shaped layer which extends around the outer periphery of separation chamber 8 and can be seen through the transparent cover 6. Thus it is not necessary to employ means such as a stroboflash to observe the state of separation of the specimen, such as is necessary with prior art types of centrifugal elutriator rotor. This fact also enables means to be provided whereby an automatic indication can be provided that the state of separation has reached a specific stage, e.g. by the optical sensor 20 which is mounted above transparent cover 6, close to the outer periphery of separation chamber 8. It will be apparent that electrical signals produced by optical sensor 20 can be employed, for example, to automatically halt rotation of rotor 2 and generate an audible or visible signal to indicate that the separation process has terminated.

It should be noted that the invention is not limited to the use of a separation chamber having the specific interior shape described for separation chamber 8 of the preferred embodiment, but that other shapes are also possible.

Thus, although the present invention has been described in the above with reference to a specific embodiment, various changes and modifications to the embodiment may be envisaged, which fall within the scope claimed for the invention as set out in the appended claims. The above specification should therefore be interpreted in a descriptive and not in a limiting sense.

What is claimed is:

1. A centrifugal elutriator rotor adapted to be rotated about a fixed axis of rotation by drive means, for continuous separation of specimen particles having specific physical properties from particles transported by a liquid buffer, comprising:

an outer body internally shaped to define an enclosed separation chamber which is disposed symmetrically around and coaxial with said axis of rotation, and;

fluid delivery inlet means communicating with an outer periphery of said separation chamber and fluid delivery outlet means communicating with an inner periphery of said separation chamber, said fluid delivery inlet means and fluid delivery outlet means being adapted to produce a continuous flow of said liquid buffer and said specimen particles transported thereby in a direction from said outer periphery to said inner periphery of said separation chamber;

said separation chamber being specifically shaped such that the areas of circumferential cross-sections of the interior of said separation chamber, respectively disposed coaxial with said axis of rotation and substantially perpendicular to said direction of flow of said liquid buffer, successively increase in inverse proportion to the respective radial distances of said circumferential cross-sections from said axis of rotation.

2. A centrifugal elutriator rotor according to claim 1, in which said outer body of said rotor is formed of a rotor body which is open at a top portion thereof and a cover which is removably attached to said rotor body such as to seal said top portion of said rotor body, and in which said specific shape of said separation chamber is formed by an upwardly concave curvature of an interior surface of said rotor body.

3. A centrifugal elutriator rotor according to claim 1, and further comprising a plurality of radially extending partitions fixedly disposed within said separation chamber at equidistant angular spacings about said axis of rotation, for dividing said separation chamber into a plurality of small separation chambers.

4. A centrifugal elutriator rotor according to claim 3, in which a part of said fluid delivery inlet means comprise fluid transfer passages respectively formed within said partitions, directed radially with respect to said axis of rotation and opening into said small separation chambers.

5. A centrifugal elutriator rotor according to claim 2, in which a screw thread is formed around an external peripheral portion of said rotor body, and further comprising an attachment ring formed with a screw thread adapted to engage said rotor body screw thread, for thereby removably attaching said cover to said rotor body by said attachment ring.

6. A centrifugal elutriator rotor according to claim 2, in which said cover is formed of an optically transparent material.

* * * * *